US008791653B2

(12) United States Patent
Wendt

(10) Patent No.: US 8,791,653 B2
(45) Date of Patent: Jul. 29, 2014

(54) APPARATUS FOR COUPLING POWER SOURCE TO LAMP

(75) Inventor: Matthias Wendt, Eindhoven (DE)

(73) Assignee: Koninklijke Philips N.V., Eindhoven (NL)

( * ) Notice: Subject to any disclaimer, the term of this patent is extended or adjusted under 35 U.S.C. 154(b) by 683 days.

(21) Appl. No.: 12/990,521

(22) PCT Filed: Apr. 30, 2009

(86) PCT No.: PCT/IB2009/051767

§ 371 (c)(1),
(2), (4) Date: Nov. 1, 2010

(87) PCT Pub. No.: WO2009/136331

PCT Pub. Date: Nov. 12, 2009

(65) Prior Publication Data

US 2011/0043130 A1 Feb. 24, 2011

(30) Foreign Application Priority Data

May 6, 2008 (EP) ..... 08103830

(51) Int. Cl.
*H05B 37/02* (2006.01)
*H05B 33/08* (2006.01)

(52) U.S. Cl.
USPC ..... 315/307; 315/224; 315/291

(58) Field of Classification Search
USPC ..... 315/291, 185 R, 307, 312, 209 R, 224, 315/225
See application file for complete search history.

(56) References Cited

U.S. PATENT DOCUMENTS

| | | | | |
|---|---|---|---|---|
| 5,396,155 | A | 3/1995 | Bezdon et al. | |
| 5,661,645 | A * | 8/1997 | Hochstein | 363/89 |
| 6,051,935 | A * | 4/2000 | Bucks et al. | 315/224 |
| 8,207,687 | B1 * | 6/2012 | Rhodes | 315/307 |
| 2003/0102821 | A1 | 6/2003 | Van Der Veen et al. | |
| 2005/0030192 | A1 * | 2/2005 | Weaver et al. | 340/815.45 |
| 2007/0262765 | A1 | 11/2007 | Joos et al. | |
| 2008/0116818 | A1 * | 5/2008 | Shteynberg et al. | 315/192 |
| 2008/0155714 | A1 | 6/2008 | Gontier et al. | |

FOREIGN PATENT DOCUMENTS

| | | | |
|---|---|---|---|
| CA | 2433711 | A1 | 12/2003 |
| EP | 1732364 | A2 | 12/2006 |

* cited by examiner

*Primary Examiner* — Jimmy Vu
*Assistant Examiner* — Amy Yang
(74) *Attorney, Agent, or Firm* — Yuliya Mathis

(57) ABSTRACT

An apparatus coupling a power source to a light emitting diode lamp includes a first part for receiving first voltage and current signals from the power source and a second part for supplying second voltage and current signals to the lamp. The first part includes a detection part for detecting a first amplitude reduction in at least one of the first signals, for example in the first voltage signal, and the second part includes an introduction part for, in response to a detection result, introducing a second amplitude reduction into at least one of the second signals, for example into the second current signal. As a result, the first part detects a first dimming state caused by the power source, and the second part introduces a second dimming state in response to the first part having detected the first dimming state, and the apparatus has self-dimming capabilities, to keep the grid stable.

18 Claims, 4 Drawing Sheets

APPARATUS FOR COUPLING POWER SOURCE TO LAMP

FIELD OF THE INVENTION

The invention relates to an apparatus for coupling a power source to a lamp, and also relates to a device comprising an apparatus, to a method, to a computer program product, and to a medium.

Examples of such an apparatus are lamp drivers and lamp interfaces. Examples of such a device are lamps and power supplies.

BACKGROUND OF THE INVENTION

US 2007/0262765 A1 discloses a method of controlling an electrical light source by pulse width modulation, to keep a brightness of the electrical light source constant.

SUMMARY OF THE INVENTION

It is an object of the invention to provide an apparatus for coupling a power source to a lamp, which apparatus has a simple construction with self-dimming capabilities.

Further objects of the invention are to provide a device, a method, a computer program product, and a medium.

According to a first aspect of the invention, an apparatus is provided for coupling a power source to a lamp, the lamp comprising one or more light emitting diodes, the apparatus comprising

- a first part for receiving a first voltage signal and a first current signal from the power source, the first part comprising a detection part for detecting a first amplitude reduction (e.g., see ΔA in FIG. 6) in at least one of the first signals, and
- a second pad for supplying a second voltage signal and a second current signal to the lamp, the second part comprising an introduction part for, in response to a detection result, introducing a second amplitude reduction into at least one of the second signals.

The first part, such as a first (part of a) circuit, receives a first voltage signal and a first current signal from a power source. This first part comprises a detection part for detecting a first amplitude reduction in at least one of these first signals. The second part, such as a second (part of the) circuit, supplies a second voltage signal and a second current signal to the lamp. This second part comprises an introduction part for, in response to a detection result, introducing a second amplitude reduction into at least one of these second signals. As a result, the first part detects a first dimming state caused by the power source, and the second part introduces a second dimming state in response to the first part having detected the first dimming state.

By virtue of the creation of the first and second parts, the apparatus is of a simple construction. The second dimming state is an additional dimming state that is introduced in response to the first dimming state and that gives the apparatus self-dimming capabilities.

By using a lamp comprising one or more light emitting diodes, such as organic light emitting diodes, inorganic light emitting diodes and/or laser light emitting diodes, this lamp, compared to other kinds of lamps, will be less sensitive to said amplitude reductions. This lamp can be easily dimmed without sacrificing life time and maintenance. It directly returns to nominal operation when nominal power is supplied again. In addition, it should be noted that the lumen efficiency of such lamps mostly rises for a current below a nominal current. For example, for some light emitting diode products, the best performance is measured at about one fourth of the nominal power. This means in practice that a reduction in input power results in a smaller reduction in light flux.

The second amplitude reduction may be a fixed amplitude reduction or may be a flexible amplitude reduction, depending on the first amplitude reduction and/or on further data such as the time of day.

According to an embodiment, the apparatus is defined by the first amplitude reduction being an amplitude reduction of the first voltage signal, and the second amplitude reduction being an amplitude reduction of the second current signal. So, preferably, an amplitude reduction of the first voltage signal from the power source is detected, and in response thereto an amplitude reduction of the second current signal destined for the lamp is introduced.

According to an embodiment, the apparatus is defined by the first amplitude reduction resulting in an output power of the power source being reduced, and the second amplitude reduction resulting in the output power being further reduced. So, preferably, in case the power source supplies power at a decreased level, the combination of the apparatus and the lamp will require power at a further decreased level from the power source, to keep the grid stable.

According to an embodiment, the apparatus is characterized in that

- the detection part comprises a comparison part for comparing an amplitude of said at least one of the first signals with a threshold value and comprises a generation part for, in response to a comparison result, generating a control signal, and
- the introduction part comprises a circuit for, in response to said control signal, controlling an amplitude of said at least one of the second signals.

The comparison part may comprise an analog comparator for comparing an analog amplitude value of said at least one of the first signals with an analog threshold value or may comprise a digital comparator for comparing a digital amplitude value of said at least one of the first signals with a digital threshold value. The generation part may comprise an analog generator for, in response to a comparison result, generating an analog control signal or may comprise a digital generator for, in response to a comparison result, generating a digital control signal. The introduction part may be an analog introduction part comprising an analog circuit for controlling an amplitude of said at least one of the second signals or may be a digital introduction part comprising a digital circuit for controlling an amplitude of said at least one of the second signals. The analog parts may each form part of one or more chips, and the digital parts may each form part of one or more processors. Analog-to-digital converters and digital-to-analog converters may need to be introduced. An analog circuit may comprise semiconductor circuitry such as a transistor, a thyristor and/or a triac. A digital circuit may comprise logic circuitry, possibly followed by an analog circuit.

According to an embodiment, the apparatus is characterized by a first duration of the first amplitude reduction being equal to or shorter than a second duration of the second amplitude reduction. The second duration of the second amplitude reduction may be a fixed duration or may be a flexible duration, depending on the first duration and/or on the first amplitude reduction and/or on further data such as the time of day.

According to an embodiment, the apparatus is characterized in that

- the detection part is arranged for detecting a further first amplitude reduction in said at least one of the first signals, said further first amplitude reduction being different from said first amplitude reduction, and the introduction part is arranged for, in response to a further detection result, introducing a further second amplitude reduction into said at least one of the second signals, said further second amplitude reduction being different from said second amplitude reduction.

The detection part may be able to detect different first amplitude reductions in said at least one of the first signals, and the introduction part may be able to introduce respective different second amplitude reductions into said at least one of the second signals in response to detections of respective different first amplitude reductions in said at least one of the first signals. In this case, different first amplitude reductions result in different second amplitude reductions.

According to an embodiment, the apparatus is characterized in that the detection part is arranged for detecting a further first amplitude reduction in said at least one of the first signals, said further first amplitude reduction being different from said first amplitude reduction, and the introduction part is arranged for, in response to a further detection result, introducing a further second amplitude reduction into said at least one of the second signals, a second duration of the second amplitude reduction being different from a further second duration of the further second amplitude reduction.

The detection part may be able to detect different first amplitude reductions in said at least one of the first signals, and the introduction part may be able to introduce respective second amplitude reductions into said at least one of the second signals in response to detections of respective different first amplitude reductions in said at least one of the first signals, said respective second amplitude reductions having respective different second durations. In this case, different first amplitude reductions result in second amplitude reductions having different second durations.

According to an embodiment, the apparatus is characterized in that the first amplitude reduction (e.g., see ΔA in FIG. 6) has a first slope (e.g., see 605 in FIG. 6), which first slope can be detected by the detection part. Such a first slope for example defines a size of the first amplitude reduction per time-interval (e.g., see ΔT in FIG. 6), such as a detected size of the first amplitude reduction (e.g., see ΔA in FIG. 6) per fixed time-interval (e.g., see ΔA in FIG. 6) or such as a fixed size of the first amplitude reduction per detected time-interval or such as a detected size of the first amplitude reduction per detected time-interval. This first slope may give further information about the first amplitude reduction.

According to an embodiment, the apparatus is characterized in that the second amplitude reduction has a second slope, which second slope can be introduced by the introduction part. Such a second slope for example defines a size of the second amplitude reduction per time-interval and may or may not depend on the first slope.

Slopes or ramping functions may be used to get an automatic behavior over time that may help to keep flux changes within margins.

According to an embodiment, the apparatus is characterized in that the detection part is arranged for detecting the first amplitude reduction (e.g., see ΔA in FIG. 6) per time-interval (e.g., see ΔT in FIG. 6), and the introduction part is arranged for introducing the second amplitude reduction only in case of the first amplitude reduction being larger than an amplitude threshold and/or in case of the time-interval (e.g., see ΔT in FIG. 6) being smaller than a time-interval threshold (e.g., see $T_{TH}$ in FIG. 6).

By detecting the first amplitude reduction per time-interval, such as a detection of a size of the first amplitude reduction per fixed time-interval or such as a detection of a time-interval per fixed size of the first amplitude reduction or such as a detection of a size of the first amplitude reduction per detection of a time-interval, it has become possible to reduce the second amplitude only in case of the first amplitude reduction being larger than an amplitude threshold and/or in case of the time-interval being smaller than a time-interval threshold. Then, for example, a sine phase can be recorded and can be compared cycle by cycle, to introduce auto-adaptivity. For example, relatively slow changes in mains amplitude that are due to network control and normal fluctuations will not result in an action, but relatively rapid changes that are mostly due to broken fuses or overloaded mains, become detectable even before a full sine cycle has been completed.

According to an embodiment, the apparatus is characterized in that the first part comprises a rectifier for rectifying mains voltage and current signals into the first voltage and current signals and comprises a first serial circuit of resistors and a second serial circuit of a diode and a capacitor, an output of the rectifier being coupled to an input of the first and second serial circuits, an output of the first serial circuit being coupled to an input of the detection part, and the second part comprises a control input coupled to an output of the detection part and comprises an input coupled to an output of the second serial circuit and comprises an output to be coupled to the lamp.

This embodiment is advantageous in that it is extremely simple and low cost.

According to a second aspect of the invention, a device is provided comprising the apparatus and further comprising the lamp and/or further comprising a power supply.

According to a third aspect of the invention, a method is provided for interfacing a power source and a lamp, the lamp comprising one or more light emitting diodes, the method comprising a detection step of detecting a first amplitude reduction in at least one of first voltage and current signals received from the power source, and an introduction step of, in response to a detection result, introducing a second amplitude reduction into at least one of second voltage and current signals to be supplied to the lamp.

According to a fourth aspect of the invention, a computer program product is provided for interfacing a power source and a lamp, the lamp comprising one or more light emitting diodes, the computer program product comprising a detection function of detecting a first amplitude reduction in at least one of first voltage and current signals received from the power source, and an introduction function of, in response to a detection result, introducing a second amplitude reduction into at least one of second voltage and current signals to be supplied to the lamp.

According to a fifth aspect, a medium is provided for storing and comprising the computer program product.

Embodiments of the device and of the method and of the computer program product and of the medium correspond to the embodiments of the apparatus.

An insight might be that an amplitude reduction in a power source voltage signal should not lead to an amplitude increase in a lamp current signal. In other words, an insight might be that a lamp power should not be kept constant for a decreasing power source voltage.

A basic idea might be that a first amplitude reduction in a power source signal is to be detected, and, in response to a detection result, a second amplitude reduction is to be introduced into a lamp signal.

A problem to provide an apparatus for coupling a power source to a lamp, which apparatus has a simple construction with self-dimming capabilities, is solved.

An advantage might be that a lamp comprising one or more light emitting diodes, compared to other kinds of lamps, will be less sensitive to said amplitude reductions.

These and other aspects of the invention are apparent from and will be elucidated with reference to the embodiment(s) described hereinafter.

DETAILED DESCRIPTION OF EMBODIMENTS

Figure 1:
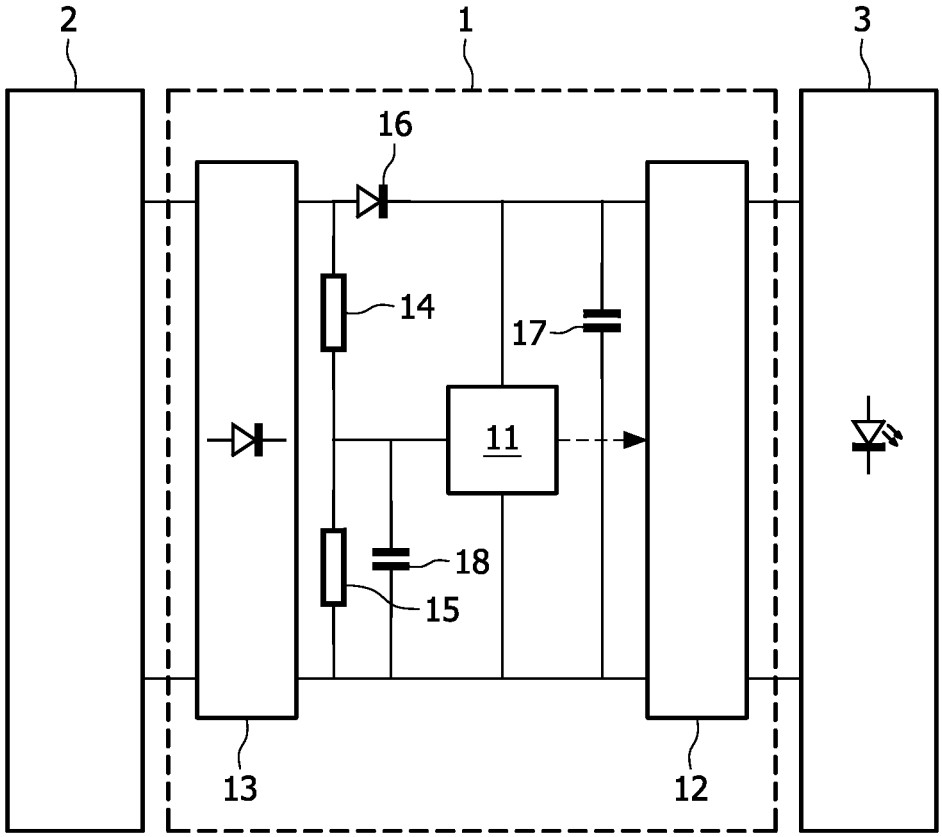
FIG. 1 shows an embodiment of an apparatus.

In FIG. 1, an embodiment of an apparatus 1 for coupling a power source 2 and a lamp 3 is shown. The lamp 3 comprises one or more light emitting diodes. In case the lamp 3 comprises two or more light emitting diodes, any two or more light emitting diodes may be interconnected in an at least partly serial connection and/or in an at least partly parallel connection. The apparatus 1 comprises a first part for receiving a first voltage signal and a first current signal from the power source 2, such as the mains. This first part comprises a detection part 11 for detecting a first amplitude reduction in at least one of the first signals. The apparatus 1 further comprises a second part for supplying a second voltage signal and a second current signal to the lamp 3. This second part comprises an introduction part 12 for, in response to a detection result, introducing a second amplitude reduction into at least one of the second signals.

Usually, said amplitude reductions are real time amplitude reductions, and (an introduction of) a start of a second amplitude reduction will advantageously be introduced a relatively short period of time from (a detection of) a start of a first amplitude reduction. Alternatively, one or more of said amplitude reductions may be average amplitude reductions. Preferably, the first amplitude reduction is an amplitude reduction of the first voltage signal, and the second amplitude reduction is an amplitude reduction of the second current signal. Further preferably, the first amplitude reduction results in an output power of the power source 2 being reduced and the second amplitude reduction results in this output power being further reduced.

The first part may further comprise a rectifier 13 for example comprising one diode or comprising four diodes in a bridge for rectifying voltage and current signals from the mains into the first voltage and current signals. The first part may further comprise a first serial circuit of resistors 14 and 15 and a second serial circuit of a diode 16 and a capacitor 17. Outputs of the rectifier 13 are coupled to inputs of the first and second serial circuits. An output of the first serial circuit (the interconnection between the resistors 14 and 15) is coupled to an input of the detection part 11. Possibly, a further capacitor 18 may be located in parallel with the resistor 15.

The introduction part 12 of the second part comprises a control input coupled to an output of the detection part 11 and comprises inputs coupled to an output of the second serial circuit (the interconnection between the diode 16 and the capacitor 17) and to an output of the rectifier and comprises outputs to be coupled to the lamp 3.

Figure 2:
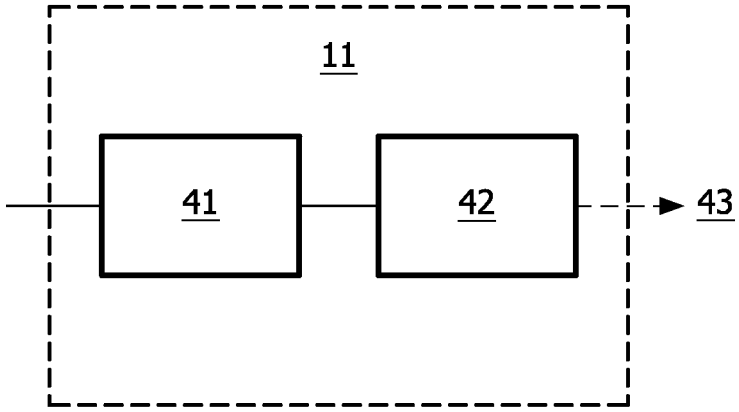
FIG. 2 shows an embodiment of a detection part of said apparatus.

In FIG. 2, an embodiment of the detection part 11 of said apparatus 1 is shown. The detection part 11 may for example comprise a comparison part 41 for comparing an amplitude of said at least one of the first signals with a threshold value and may for example comprise a generation part 42 for, in response to a comparison result, generating a control signal to be supplied to the introduction part 12 via an interconnection 43.

Figure 3:
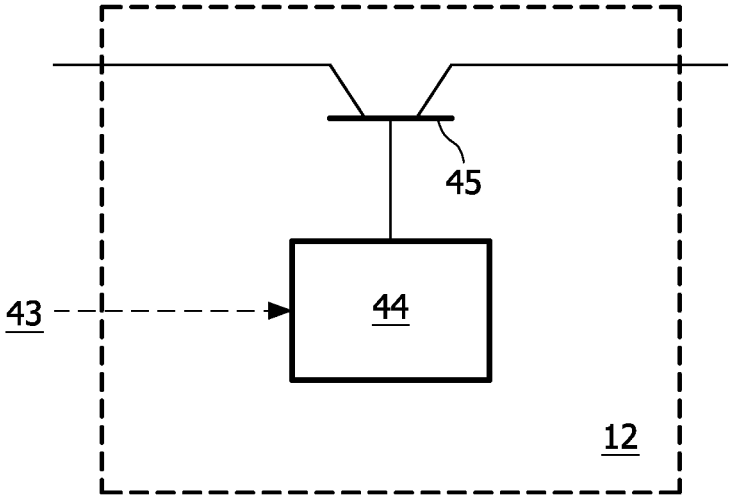
FIG. 3 shows an embodiment of an introduction part of said apparatus.

In FIG. 3, an embodiment of the introduction part 12 of said apparatus 1 is shown. The introduction part 12 may for example comprise a circuit 44, 45 comprising circuitry 44 coupled to said interconnection 43 and a transistor 45 for, in response to said control signal, controlling an amplitude of said at least one of the second signals.

The parts 41 and 42 and the circuitry 43 may each be based on analog technology or digital technology or a mixture of both. One or more analog-to-digital converters and one or more digital-to-analog converters may be present inside the parts 41 and 42 and the circuitry 43, or may be added to one or more inputs and one or more outputs of these parts 41 and 42 and of the circuitry 43. Instead of a transistor 45, other semiconductors and more complex circuitry may be used. So, an embodiment with more complex circuitry, that introduces a second amplitude reduction in a second signal via for example a pulse width modulated duty cycle or any other kind of modulation scheme that results in an amplitude modification, in dependence on a measured first amplitude reduction of the first signal, is also included. Such a modulation scheme or switching pattern for amplitude modification may for example comprise pulse density modulation, frequency modulation, phase angle modulation, phase shift modulation etc.

The resistors 14 and 15 form a voltage divider, such that a peak voltage can be compared with a threshold. Alternatively, such a voltage divider may be left out, or may be integrated into the detection part 11, or may be located behind the capacitor 17, or may be replaced by other circuitry such as a transformer. Further alternatively, instead of a peak voltage, another voltage such as for example an average voltage may be compared with the threshold. The diode 16 has a decoupling function; alternative decoupling circuitry may be used. The detection part 11 may alternatively perform a calculation for detection purposes, in which case a calculation result takes the place of or is illustrative of the detection result. The introduction part 12 may comprise a light emitting diode driver. The detection part 11 is fed via the rectifier 13, but may alternatively be fed via a battery or another source. The power source 2 may alternatively be a power supply such as an AC-DC converter fed by the mains, or a DC-DC converter fed by a battery, or another battery or solar operated system, etc.

Figure 4:
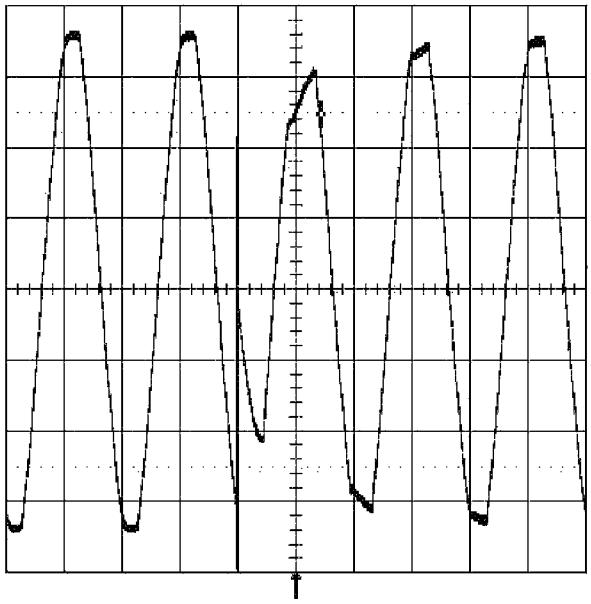
FIG. 4 shows a first graph of a weak mains.
Figure 5:
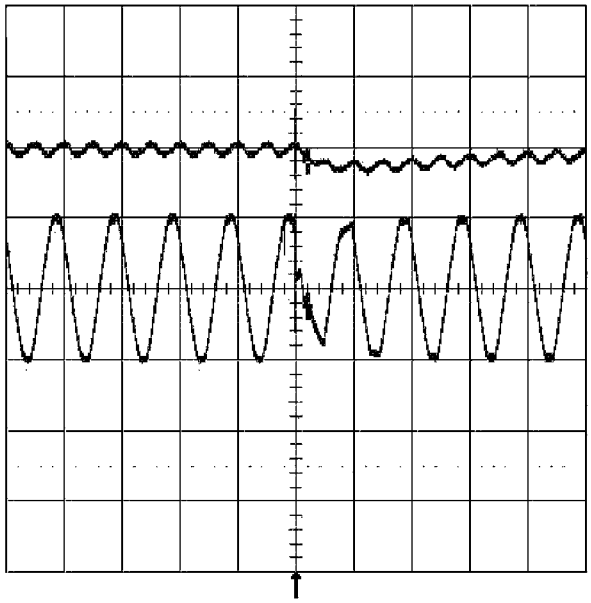
FIG. 5 shows a second graph of a weak mains and a monitor signal.
Figure 6:
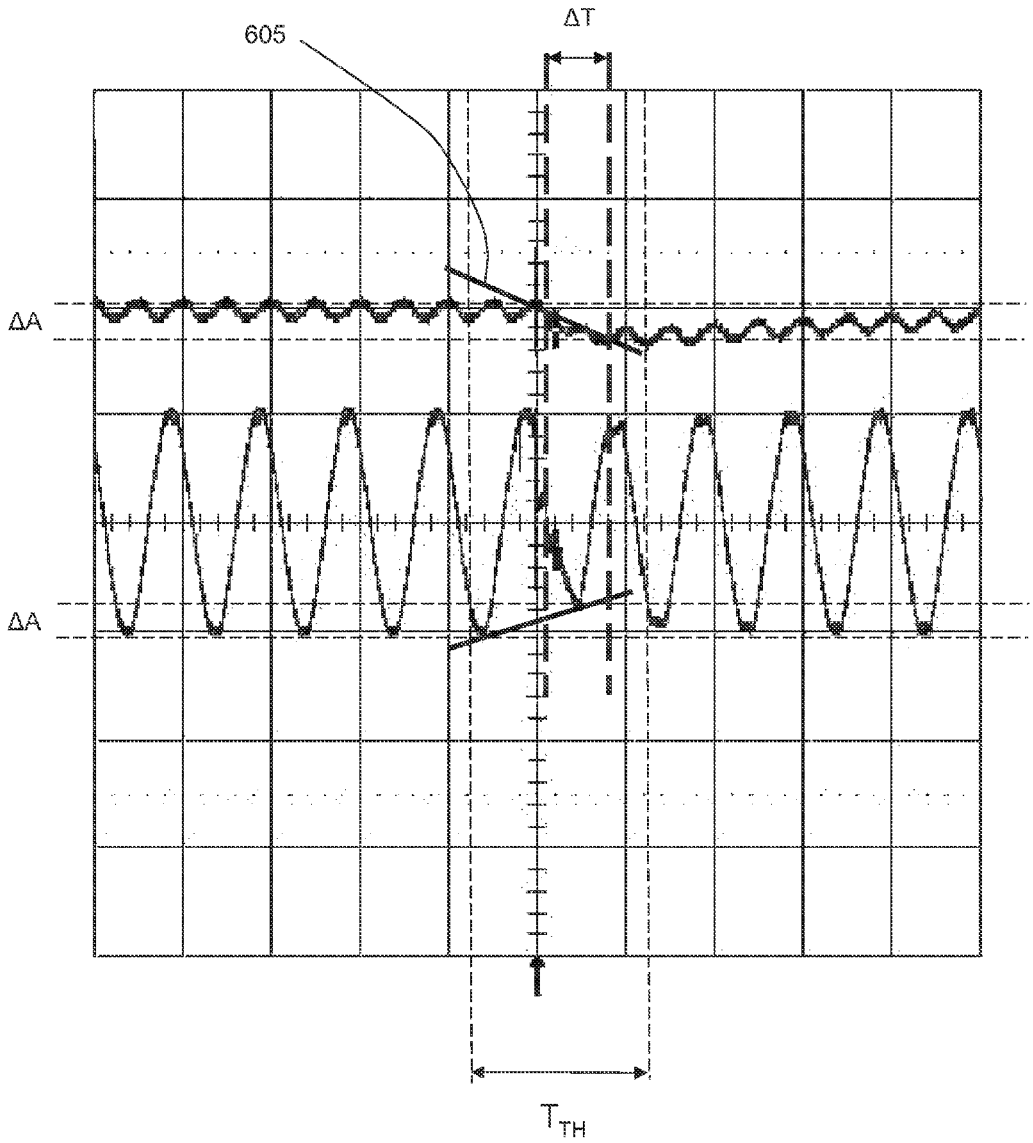
FIG. 6 shows a third graph of a weak mains and a monitor signal.

In FIG. 4, a first graph of (weak) mains is shown, and in FIG. 5, a second graph of (weak) mains and a monitor signal is shown, both voltage versus time. The monitor signal is for example the signal to be supplied to the detection part 11. For example, a normal monitor signal may be 100 Hz after rectification to around 20V. When it falls below 19.2V, the system detects weak mains and commands the lamp 3 to reduce brightness.

Several general methods can be applied, such as an instantaneous reduction to a fixed dim level, or a smooth reduction in connection with the mains voltage reduction. To keep the brightness in weak grids from flickering, the dimming should softly increment when the mains voltage is getting stronger. E.g. the dimming should increase with a predefined percentage per mains period.

To execute complex control schemes it might be more appropriate to monitor the voltage by means of an analog-to-digital converter of a digital controller. In many new lamps a μC might be used anyway for dimming, color control and remote control decoding. In these lamps the μC is beneficially used to analyze the mains waveforms and execute the dimming scheme as sketched above.

An improved embodiment might even react to different degrees of mains dips with different measures. For instance, in the case of a very deep dip, the power consumption may be switched off completely for a short fraction, to allow the mains to get back to normal more easily. Instead of a fixed threshold, it might be more appropriate to have an averaging means that measures the average voltage constantly and dynamically adjusts the threshold relative to that measured average voltage.

If a digital controller is used it might be possible to store waveforms of a couple of mains periods and compare the actual value synchronously to earlier measurements. In this way, deviations can instantly be recognized. For this purpose, the μC may need some storage capacity to store the old values. The further capacitor 18 can be given a smaller value in order to be able to detect deviations more instantly. In this way the lamp 3 can even reduce its power before the mains voltage drops below a certain limit.

Time ramps for the changes in dimming values (possibly different for up and down situations) allow to make the resulting changes in lamp brightness as subtle as possible as long as the input does not ask for an immediate (and also visible) reaction.

These kinds of apparatuses, such as for example electric SSL ballasts, may become required by utilities for special power pricing in the future, because light emitting diode lamps can react relatively instantly on mains changes in a non-centrally controlled fashion. The additional effort in the lamp controller may be very small.

An additional application might be to perform dimming of the light emitting diode lamp by means of reducing the grid voltage centrally. This control method is known from street lighting but does not work with existing electronic drivers, because these drivers counteract by increasing their output current via their internal current control mechanism.

In a further embodiment a separate controller can be used that measures at a central place (e.g. a location where a floor light control is placed that passes remote commands to the lamps to reduce power). This can also be done in a way such that different lamps get different flux reductions, depending on the distribution of the lamps and the minimum functional flux required. In a further embodiment, a power station commands the lamps to dim by reducing the voltage directly or by means of intermediate power controllers on e.g. each floor.

Summarizing, an apparatus 1 for coupling a power source 2 to a light emitting diode lamp 3 comprises a first part for receiving first voltage and current signals from the power source 2 and a second part for supplying second voltage and current signals to the lamp 3. The first part comprises a detection part 11 for detecting a first amplitude reduction in at least one of the first signals, for example in the first voltage signal, and the second part comprises an introduction part 12 for, in response to a detection result, introducing a second amplitude reduction into at least one of the second signals, for example into the second current signal. As a result, the first part detects a first dimming state caused by the power source 2, and the second part introduces a second dimming state in response to the first part having detected the first dimming state, and the apparatus 1 has self-dimming capabilities, to keep the grid stable.

While the invention has been illustrated and described in detail in the drawings and foregoing description, such illustration and description are to be considered illustrative or exemplary and not restrictive; the invention is not limited to the disclosed embodiments. For example, it is possible to operate the invention in an embodiment wherein different parts of the different disclosed embodiments are combined into a new embodiment.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

LIST OF REFERENCE SIGNS

1 apparatus
2 power source
3 lamp
11 detection part
12 introduction part
13 rectifier
14 resistor
15 resistor
16 diode
17 capacitor
18 further capacitor
41 comparison part
42 generation part
43 interconnection
44 circuitry
45 transistor

The invention claimed is:

1. An apparatus for coupling a power source to a lamp, the lamp comprising one or more light emitting diodes, the apparatus comprising:

a first part for receiving a first voltage signal and a first current signal from the power source, the first part comprising a detection part for detecting a first amplitude reduction in at least one of the first signals; and a second part for supplying a second voltage signal and a second current signal to the lamp, the second part comprising an introduction part for, in response to a detection result of the detection part detecting the first amplitude reduction in at least one of the first signals, introducing a second amplitude reduction into at least one of the second signals, the first amplitude reduction resulting in an output power of the power source being reduced, and the second amplitude reduction resulting in the output power being further reduced, wherein the first amplitude reduction has a first slope, which first slope is detectable by the detection part.

2. The apparatus of claim 1, the first amplitude reduction being an amplitude reduction of the first voltage signal, and the second amplitude reduction being an amplitude reduction of the second current signal.

3. The apparatus of claim 1, wherein:

the detection part comprises a comparison part for comparing an amplitude of said at least one of the first signals with a threshold value and comprises a generation part for, in response to a comparison result, generating a control signal, and the introduction part comprises a circuit for, in response to said control signal, controlling an amplitude of said at least one of the second signals.

4. The apparatus of claim 1, a first duration of the first amplitude reduction being equal to or shorter than a second duration of the second amplitude reduction.

5. The apparatus of claim 1, wherein:

the detection part is arranged for detecting a further first amplitude reduction in said at least one of the first signals, said further first amplitude reduction being different from said first amplitude reduction, and the introduction part is arranged for, in response to a further detection result, introducing a further second amplitude reduction into said at least one of the second signals, said further second amplitude reduction being different from said second amplitude reduction.

6. The apparatus of claim 1, wherein:

the detection part is arranged for detecting a further first amplitude reduction in said at least one of the first signals, said further first amplitude reduction being different from said first amplitude reduction, and the introduction part is arranged for, in response to a further detection result, introducing a further second amplitude reduction into said at least one of the second signals, a second duration of the second amplitude reduction being different from a further second duration of the further second amplitude reduction.

7. The apparatus according to claim 1, wherein the first part comprises a rectifier for rectifying mains voltage and current signals into the first voltage and current signals and comprises a first serial circuit of resistors and a second serial circuit of a diode d a capacitor, an output of the rectifier being coupled to an input of the first and second serial circuits, an output of the first serial circuit being coupled to an input of the detection part, and the second part comprises a control input coupled to an output of the detection part and comprises an input coupled to an output of the second serial circuit and comprises an output to be coupled to the lamp.

8. The apparatus of claim 1, further comprising the lamp and/or a power supply.

9. An apparatus for coupling a power source to a lamp, the lamp comprising one or more light emitting diodes, the apparatus comprising:

a first part for receiving a first voltage signal and a first current signal from the power source, the first part comprising a detection part for detecting a first amplitude reduction in at least one of the first signals; and a second part for supplying a second voltage signal and a second current signal to the lamp, the second part comprising an introduction part for, in response to a detection result, introducing a second amplitude reduction into at least one of the second signals, wherein the first amplitude reduction has a first slope, which first slope is detectable by the detection part.

10. The apparatus of claim 9, wherein the second amplitude reduction has a second slope, which second slope is introduced by the introduction part.

11. The apparatus of claim 9, the first amplitude reduction being an amplitude reduction of the first voltage signal, and the second amplitude reduction being an amplitude reduction of the second current signal.

12. The apparatus of claim 9, wherein:

the detection part comprises a comparison part for comparing an amplitude of said at least one of the first signals with a threshold value and comprises a generation part for, in response to a comparison result, generating a control signal, and the introduction part comprises a circuit for, in response to said control signal, controlling an amplitude of said at least one of the second signals.

13. The apparatus of claim 9, a first duration of the first amplitude reduction being equal to or shorter than a second duration of the second amplitude reduction.

14. The apparatus of claim 9, wherein:

the detection part is arranged for detecting a further first amplitude reduction in said at least one of the first signals, said further first amplitude reduction being different from said first amplitude reduction, and the introduction part is arranged for, in response to a further detection result, introducing a further second amplitude reduction into said at least one of the second signals, said further second amplitude reduction being different from said second amplitude reduction.

15. The apparatus of claim 9, wherein:

the detection part is arranged for detecting a further first amplitude reduction in said at least one of the first signals, said further first amplitude reduction being different from said first amplitude reduction, and the introduction part is arranged for, in response to a further detection result, introducing a further second amplitude reduction into said at least one of the second signals, a second duration of the second amplitude reduction being different from a further second duration of the further second amplitude reduction.

16. The apparatus of claim 9, wherein the second amplitude reduction has a second slope, which second slope is introduced by the introduction part.

17. The apparatus of claim 9, wherein:

the detection part is arranged for detecting the first amplitude reduction per time-interval, and the introduction part is arranged for introducing the second amplitude reduction only in case of the first amplitude reduction being larger than an amplitude threshold and/or in case of the time-interval being smaller than a time-interval threshold.

18. An apparatus for coupling a power source to a lamp, the lamp comprising one or more light emitting diodes, the apparatus comprising:

a first part for receiving a first voltage signal and a first current signal from the power source, the first part comprising a detection part for detecting a first amplitude reduction in at least one of the first signals; and a second part for supplying a second voltage signal and a second current signal to the lamp, the second part comprising an introduction part for, in response to a detection result of the detection part detecting the first amplitude reduction in at least one of the first signals, introducing a second amplitude reduction into at least one of the second signals, the first amplitude reduction resulting in an output power of the power source being reduced, and the second amplitude reduction resulting in the output power being further reduced, wherein:

the detection part is arranged for detecting the first amplitude reduction per time-interval, and the introduction part is arranged for introducing the second amplitude reduction only in case of the first amplitude reduction being larger than an amplitude threshold and/or in case of the time-interval being smaller than a time-interval threshold.

* * * * *